US007345651B2

(12) United States Patent
Numoto

(10) Patent No.: US 7,345,651 B2
(45) Date of Patent: Mar. 18, 2008

(54) ANTENNA

(75) Inventor: Tatsuhiko Numoto, Osaka (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 6 days.

(21) Appl. No.: 11/407,052

(22) Filed: Apr. 20, 2006

(65) Prior Publication Data

US 2006/0238431 A1 Oct. 26, 2006

(30) Foreign Application Priority Data

Apr. 21, 2005 (JP) ..... 2005-123227

(51) Int. Cl.
*H01Q 1/36* (2006.01)

(52) U.S. Cl. ..... 343/897

(58) Field of Classification Search ..... 343/700 MS, 343/702, 897, 795, 745, 749–752
See application file for complete search history.

(56) References Cited

U.S. PATENT DOCUMENTS 3,339,205 A * 8/1967 Smitka ..... 343/701
6,529,170 B1 * 3/2003 Nishizawa et al. ..... 343/795
6,552,689 B2 * 4/2003 Shinichi ..... 343/702
7,176,840 B1 * 2/2007 Kelley ..... 343/745
2002/0101383 A1 * 8/2002 Junod ..... 343/742
2004/0214545 A1 * 10/2004 Kushima et al. ..... 455/232.1
2005/0280579 A1 * 12/2005 Liang et al. ..... 343/700 MS

FOREIGN PATENT DOCUMENTS

JP 62-260403 A 11/1987

* cited by examiner

*Primary Examiner*—Huedung Mancuso
(74) *Attorney, Agent, or Firm*—McDermott Will & Emery LLP

(57) ABSTRACT

An antenna having excellent receiving sensitivity for radio waves of two or more different frequency bands is achieved with a relatively simple configuration using a single cord. The antenna of the present invention is made up of a single cord which has one end connected to a plug and includes at least one inductor inserted at a certain point of the cord. A length from one end to the other end of the cord and a length from the one end to a position where one of the inductors is connected are n/4 (n represents 1, 2, 3 or 4) of a wavelength at the center frequency of one of the two or more frequency bands or a frequency around the center frequency, and the at least one inductor has a self-resonant frequency matching with the center frequency of the frequency band corresponding to the length from the one end to the position where the inductor is connected or matching with a frequency around the center frequency.

4 Claims, 3 Drawing Sheets

ANTENNA

FIELD OF THE INVENTION

The present invention relates to an antenna for use in connection to a receiver such as a television receiver.

BACKGROUND OF THE INVENTION

Conventional antenna circuits including antenna gain correction circuits are available as described in, for example, Japanese Laid-Open Patent Publication No. 62-260403. The following will describe a conventional antenna circuit with reference to the accompanying drawings.

FIG. 4 shows an example in which an antenna circuit is used for a small television receiver meeting US specifications. Basically an antenna gain correction circuit 42 comprises a parallel circuit of an inductor 44, a capacitor 47, and capacitors 46 and 48. In this circuit, the capacitors include a variable-capacitance diode 46 which varies in capacitance in response to the control of a receiving circuit 43 and the capacitors 47 and 48 which have fixed capacitances. Reference numeral 45 denotes a choke coil.

The inductor 44 is a chip inductor having a nominal inductance of 0.33 μH and a self-resonant frequency of 350 MHz. In response to the control of the receiving circuit 43, the variable-capacitance diode 46 varies in capacitance from 2 pF to 12 pF and the combined capacitance of the capacitors changes from 4.5 pF to 9 pF. As a result, the impedance characteristics of the antenna gain correction circuit 42 change and the self-resonant frequency changes between 85 MHz and 120 MHz. For example, when Channel 2 is received, the antenna gain correction circuit 42 has a self-resonant frequency of 85 MHz and an impedance of about 300Ω.

As the low band of the VHF band is sequentially selected from Channel 2 to Channel 6, the capacitance of the variable-capacitance diode 46 is changed in response to the control of the receiving circuit 43 and the self-resonant frequency of the antenna gain correction circuit 42 is successively changed from 85 MHz to 120 MHz. As a result, the impedance of a receiving channel is also successively changed from about 300Ω to 100Ω and the impedance characteristics of the antenna gain correction circuit 42 are optimized for each channel.

As described above, in the conventional antenna circuit, the antenna circuit is optimized by changing the impedance characteristics of the antenna gain correction circuit 42. However, the use of the variable-capacitance diode complicates the structure and increases the cost.

BRIEF SUMMARY OF THE INVENTION

It is an object of the present invention to achieve an antenna which has excellent receiving sensitivity for two or more different frequency bands with relatively low cost and a simple configuration.

The antenna of the present invention is an antenna attachable to a receiver for selectively receiving radio waves of two or more frequency bands, the antenna comprising: a plurality of conducting wires which have one end connectable to the receiver and are connected in series, and at least one inductor inserted between the plurality of conducting wires, a length from the one end to the other end of the plurality of conducting wires and a length from the one end to a position where one of the inductors is connected are n/4 (n represents 1, 2, 3 or 4) of a wavelength at the center frequency of one of the two or more frequency bands or a frequency around the center frequency, and the at least one inductor has a self-resonant frequency matching with the center frequency of the frequency band corresponding to the length from the one end to the position where the inductor is connected or matching with a frequency around the center frequency.

According to the present invention, substantially with a single conducting wire, it is possible to achieve an antenna which has excellent receiving sensitivity for two or more different frequency bands.

The antenna of the present invention may comprise two inductors and three conducting wires to receive radio waves of the upper band of the UHF band through the first conducting wire, receive radio waves of the lower band of the UHF band through the first and second conducting wires, and receive radio waves of the VHF band through the first, second and third conducting wires.

Further, the antenna of the present invention may be also used as a cable for headphones, and each of two or more cords making up the cable may comprise the plurality of conducting wires and the at least one inductor.

While the novel features of the invention are set forth particularly in the appended claims, the invention, both as to organization and content, will be better understood and appreciated, along with other objects and features thereof, from the following detailed description taken in conjunction with the drawings.

DETAILED DESCRIPTION OF THE INVENTION

The following will describe antennas according to embodiments of the present invention with reference to the accompanying drawings.

Embodiment 1

Figure 1:
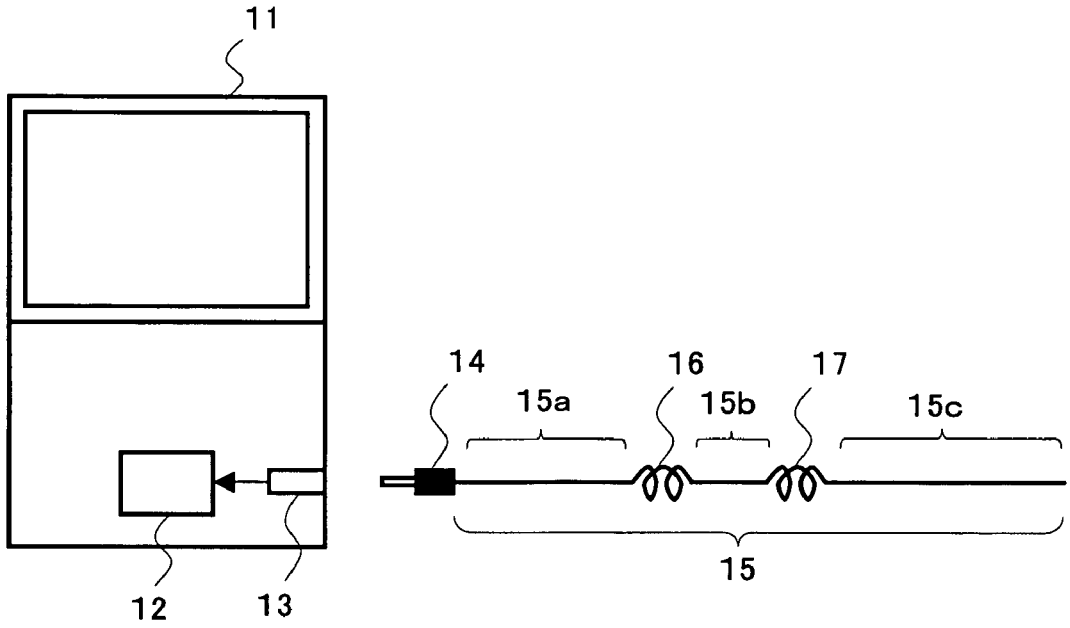
FIG. 1 is a structural diagram showing a TV receiver including an antenna cord according to Embodiment 1 of the present invention.

The present embodiment will discuss an example of an antenna of the present invention in which a conducting wire is made up of a single antenna cord. FIG. 1 is a structural diagram showing a television receiver (hereinafter referred to as a TV receiver) including the antenna cord of the present invention. The TV receiver is an example of the receiver of the present invention.

In FIG. 1, reference numeral 11 denotes a TV receiver, reference numeral 12 denotes a tuner included in the TV receiver 11, reference numeral 13 denotes a jack connected to the input of the tuner 12, reference numeral 14 denotes a plug which can be inserted into the jack 13, reference numeral 15 denotes an antenna cord having one end connected to the plug 14, and reference numerals 16 and 17 denote first and second inductors inserted at certain points of the antenna cord 15. The tuner 12 of the TV receiver 11 selectively receives radio waves of two or more frequency bands.

The antenna cord 15, which is a conducting wire, is split into a first antenna 15*a*, a second antenna 15*b*, and a third antenna 15*c*.

One end of the first antenna 15*a* is connected to the plug 14 and the other end thereof is connected to the first inductor 16. The length from one end to the other end of the first antenna 15*a* corresponds to ¾ of a wavelength at the center frequency of one of the two or more frequency bands or a frequency around the center frequency. The first antenna 15*a* receives radio waves of a frequency band when the wavelength at the center frequency of the frequency band or a frequency around the center frequency corresponds to the length. The first inductor 16 has a self-resonant frequency matching with the center frequency or a frequency around the center frequency of the frequency band received by the first antenna 15*a*.

One end of the second antenna 15*b* is connected to the first inductor 16 and the other end thereof is connected to the second inductor 17. The length from one end of the first antenna 15*a* to the other end of the second antenna 15*b* corresponds to ¾ of a wavelength at the center frequency of one of the two or more frequency bands or a frequency around the center frequency. The first antenna 15*a* and the second antenna 15*b* receive radio waves of a frequency band when the wavelength at the center frequency of the frequency band or a frequency around the center frequency corresponds to the length. The second inductor 17 has a self-resonant frequency matching with the center frequency or a frequency around the center frequency of the frequency band received by the first antenna 15*a* and the second antenna 15*b*.

Referring to the accompanying drawings, the following will more specifically describe the relationship between the lengths of the antennas 15*a* to 15*c* and the self-resonance frequencies of the inductors 16 and 17 in the antenna cord 15.

Figure 2:
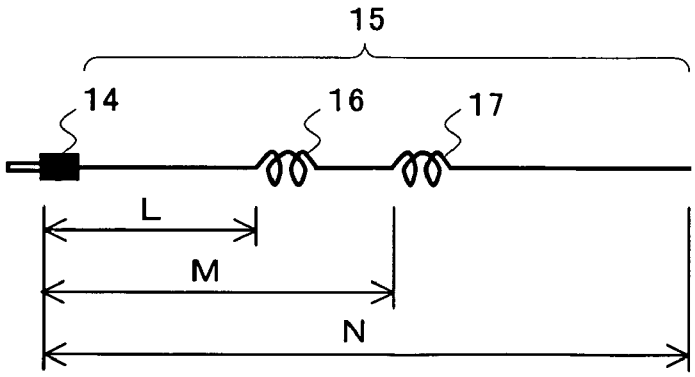
FIG. 2 is a schematic drawing showing the relationship between the configuration and lengths of the antenna cord.

FIG. 2 is a schematic drawing showing the relationship between the configuration and lengths of the antenna cord 15. In FIG. 2, reference character L denotes a length between the plug 14 and the first inductor 16, reference character M denotes a length between the plug 14 and the second inductor 17, and reference character N denotes a length from the plug 14 to the end of the antenna cord 15.

The antenna cord 15 receives radio waves of the VHF band (from 90 MHz to 222 MHz) and the UHF band (from 470 MHz to 770 MHz). The antenna length is optimized according to the wavelength of a received radio wave. According to an experimental result, the optimum antenna length corresponds to ¾ of the wavelength of a received radio wave. Therefore the entire length of the antenna cord 15 (N in FIG. 2) is determined so as to be optimum for the VHF band. Assuming that N is a length corresponding to ¾ of a wavelength at 150 MHz which is close to the center frequency of the VHF band, N is about 150 cm.

The following will describe the reception of the UHF band. Since the UHF band is a wide band ranging from 470 MHz to 770 MHz, it is difficult to receive the entire band with a single antenna. Therefore the band is divided into two, for example, a lower band from 470 MHz to 620 MHz and an upper band from 620 MHz to 770 MHz.

The UHF lower band has longer wavelength after the VHF band. The center frequency of the UHF lower band is 545 MHz and ¾ of the wavelength is about 41 cm, so that the antenna length is about 41 cm. In this configuration, the cord ahead of the second inductor 17 is shut down by the second inductor 17 in a high-frequency manner, so that the antenna length required for the UHF lower band is secured. In this case, by setting the self-resonant frequency of the second inductor 17 at 545 MHz, which is the center frequency of the UHF lower band, the cord ahead of the inductor is shut down in a high-frequency manner and the antenna length for the UHF lower band can be set at the length M shown in FIG. 2. Thus M is set at about 41 cm.

In the case where the UHF lower band cannot be entirely covered with the self-resonant frequency of the single inductor, a plurality of inductors having different self-resonant frequencies are connected in series to cover the overall UHF lower band.

This configuration makes it possible to achieve an antenna which has the optimum length for receiving the UHF lower band.

The following will describe the optimum antenna length of the UHF upper band. The center frequency of the UHF upper band is 695 MHz and ¾ of the wavelength is about 32 cm. Thus the first inductor 16 is inserted based on the same way of thinking as the second inductor 17, by which the antenna length for the UHF lower band is obtained. In this case, L in FIG. 2 is about 32 cm. Further, the self-resonant frequency of the first inductor 16 is set at 695 MHz, which is the center frequency of the UHF upper band.

As in the case of the UHF lower band, when the UHF upper band cannot be entirely covered with the self-resonant frequency of the single inductor, a plurality of inductors having different self-resonant frequencies are connected in series to cover the overall UHF upper band.

This configuration makes it possible to achieve an antenna which has the optimum length for receiving the UHF upper band.

The present embodiment described the case where the cord is used as a conducting wire. The present invention is not limited to this configuration and thus the antenna may comprise, for example, a conducting wire shaped like a metal rod.

Moreover, in the present embodiment, the lengths L, M and N of the antenna cord are each ¾ of the wavelength at the center frequency of the received frequency band, and the gain of the antenna gradually changes relative to the length of the cord. Therefore the lengths L, M and N of the antenna cord are not limited to ¾ of the wavelength at the center frequency and other lengths close to ¾ of the wavelength are acceptable as long as the same effect can be expected. In addition to ¾ of the wavelength at the center frequency, lengths corresponding to ¼, ⅔, or ⁴⁄₄ of the wavelength at the center frequency can achieve the same effect as ¾ and thus are not excluded, though gain slightly decreases.

The self-resonant frequencies of the inductors 16 and 17 are set at the center frequencies of the received frequency bands. Even when the self-resonant frequencies are slightly deviated from the center frequency, the same effect can be obtained as long as the frequencies are close to the center frequency and thus the self-resonant frequencies are not excluded.

In FIGS. 1 and 2, the two inductors are used to divide the UHF band into two. The VHF band may be divided into two in the same manner as the UHF band. In some bands which can be interrupted at the self-resonant frequencies of the inductors, it may be better to divide the UHF band into three or more. Also in this case, the same design as the two divided bands makes it possible to achieve the optimum antenna length for each band.

Although the antenna length for covering the UHF lower band is set at the length M of FIG. 2, the electrical length may look longer than ¾ of the wavelength due to the presence of the first inductor 16 at a certain point of the cord. In this case, the physical length of M in FIG. 2 is adjusted to have the optimum length. Similarly, although the antenna length for covering the VHF band is set at the length N of FIG. 2, the electrical length may look longer due to the presence of the first inductor 16 and the second inductor 17. In this case, the physical length of N in FIG. 2 is adjusted to have the optimum length.

In this way, it is possible to achieve an antenna capable of receiving radio waves of the VHF band and the UHF band substantially through a single cord.

Embodiment 2

Figure 3:
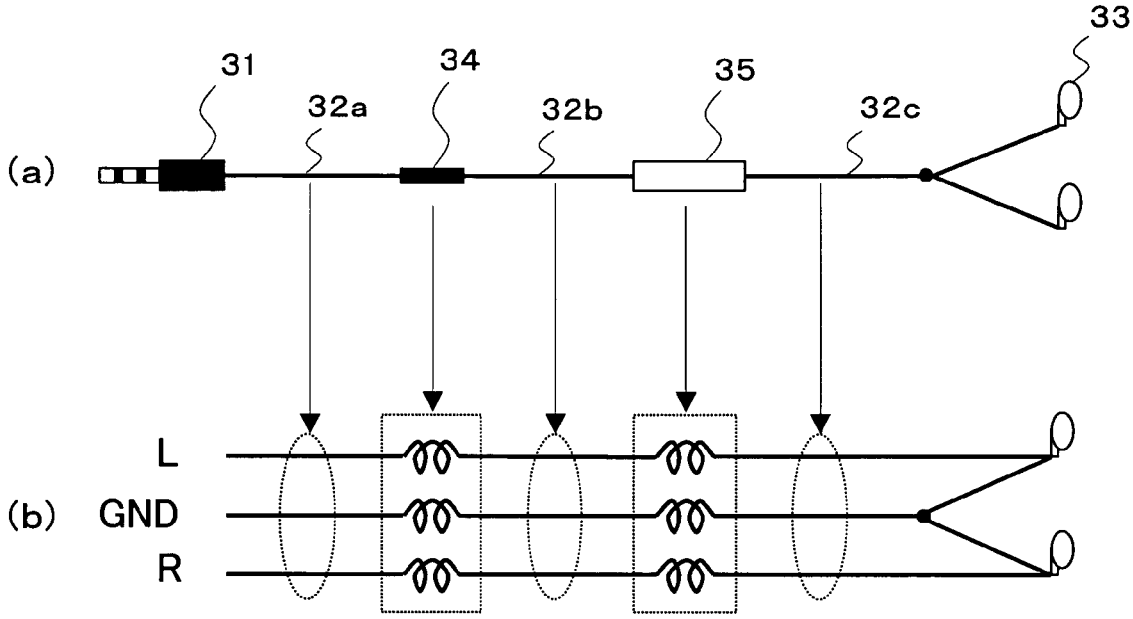
FIG. 3 is a diagram showing the appearance and circuit configuration of a cable for headphones according to Embodiment 2 of the present invention.
Figure 4:
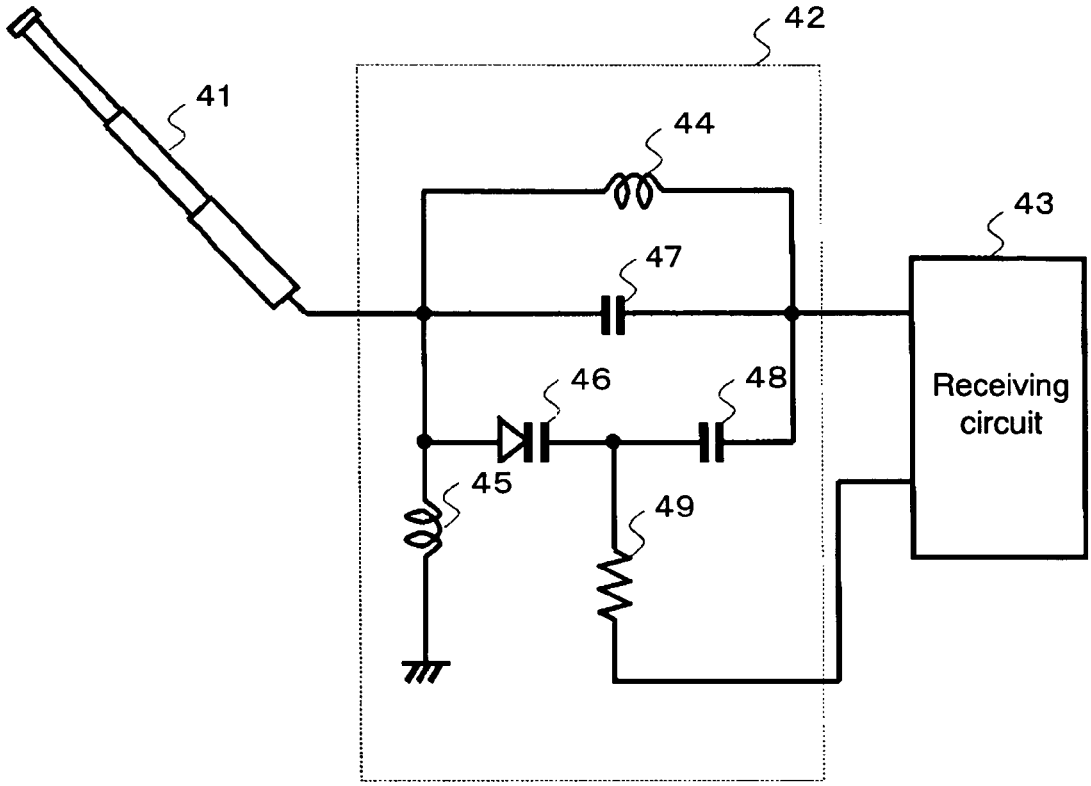
Fig.4 PRIOR ART
FIG. 4 is a circuit diagram showing the configuration of a conventional antenna circuit.

FIG. 3 is a diagram showing the configuration of an antenna according to Embodiment 2 of the present invention. In the present embodiment, a cable for headphones is also used as an antenna. FIG. 3(*a*) shows the appearance of the cable and FIG. 3(*b*) shows the circuit diagram of the cable.

In FIG. 3, reference numeral 31 denotes a plug for connecting a cable 32 to the jack 13 of the TV receiver 11 shown in FIG. 1, and reference numeral 33 denotes headphones attached to the ends of the cable 32. The plug 31 is connected to the jack 13 of the TV receiver 11, so that the headphones 33 are connected to an audio output unit of the TV receiver 11 and the cable 32 is connected to a tuner 12.

The cable 32 comprises three antennas 32*a* to 32*c* as in FIG. 1. An intermediate component 34 and a remote control 35 are inserted between the antennas. Inductors are sealed in the intermediate component 34 and the remote control 35.

The antenna cord of FIG. 1 is made up of a single cord, whereas in the present embodiment shown in FIG. 3(*b*), the cable is made up of three cords (L, R and GND) connected in parallel and thus the inductors are inserted in the respective cords. The three inductors sealed in the intermediate component 34 and the remote control 35 are basically the same type.

Further, the lengths of the antennas 32*a* to 32*c* and the resonance frequencies of the inductors inserted between the antennas 32*a* to 32*c* are basically equal to the values described in FIG. 2.

According to the present embodiment, the cable for the headphones can be also used as an antenna only by inserting the inductors at certain points of the cable. Since the cable for headphones can be also used as an antenna, a portable TV receiver using the cable does not become bulky and portability increases.

As described above, in a receiver, for example, a TV receiver for receiving radio waves of two or more different frequency bands, the antenna of the present invention makes it possible to acquire the optimum receiving sensitivity for the two or more different frequency bands with a relatively simple configuration using a single cord. The antenna of the present invention is useful for a portable TV receiver and so on.

Although the present invention has been described in terms of the presently preferred embodiments, it is to be understood that such disclosure is not to be interpreted as limiting. Various alterations and modifications will no doubt become apparent to those skilled in the art to which the present invention pertains, after having read the above disclosure. Accordingly, it is intended that the appended claims be interpreted as covering all alterations and modifications as fall within the true spirit and scope of the invention.

The invention claimed is:

1. An antenna attachable to a receiver for selectively receiving radio waves of two or more frequency bands, the antenna having a first end connectable to the receiver and a second end, said antenna comprising:

a plurality of conducting wires connected in series; and at least one inductor inserted between the plurality of conducting wires, wherein a length from the first end to the second end of the antenna and a length from the first end to a position where one of the inductors is connected are n/4 (n represents 1, 2, 3 or 4) of a wavelength at a center frequency of one of the two or more frequency bands or a frequency around the center frequency, and the at least one inductor has a self-resonant frequency matching with the center frequency of the frequency band corresponding to the length from the first end to the position where the inductor is connected or matching with a frequency around the center frequency.

2. The antenna according to claim 1, wherein the antenna comprises two inductors and a first, second and third conducting wires and the antenna is configured to receive a radio wave of an upper band of a UHF band through the first conducting wire, receive a radio wave of a lower band of the UHF band through the first and second conducting wires, and receive a radio wave of a VHF band through the first, second and third conducting wires.

3. The antenna according to claim 1, further comprising a plug attached to the first end of the antenna, the plug being connectable to a jack attached to the receiver.

4. A headphone apparatus, comprising two or more cords, at least one of the cords constituting an antenna, wherein the antenna is configured to be attachable to a receiver for selectively receiving radio waves of two or more frequency bands, the antenna having a first end connectable to the receiver and a second end, said antenna comprising:

a plurality of conducting wires connected in series; and at least one inductor inserted between the plurality of conducting wires, wherein a length from the first end to the second end of the antenna and a length from the first end to a position where one of the inductors is connected are n/4 (n represents 1, 2, 3 or 4) of a wavelength at a center frequency of one of the two or more frequency bands or a frequency around the center frequency, and the at least one inductor has a self-resonant frequency matching with the center frequency of the frequency band corresponding to the length from the first end to the position where the inductor is connected or matching with a frequency around the center frequency.

* * * * *